US010247063B2

(12) United States Patent
Altherr et al.

(10) Patent No.: US 10,247,063 B2
(45) Date of Patent: Apr. 2, 2019

(54) VALVE TRAIN FOR AN INTERNAL COMBUSTION ENGINE

(71) Applicant: Mahle International GmbH, Stuttgart (DE)

(72) Inventors: Patrick Altherr, Stuttgart (DE); David Moczko, Stuttgart (DE); Peer Niekamp, Leutenbach (DE)

(73) Assignee: Mahle International GmbH (DE)

( * ) Notice: Subject to any disclaimer, the term of this patent is extended or adjusted under 35 U.S.C. 154(b) by 92 days.

(21) Appl. No.: 15/627,050

(22) Filed: Jun. 19, 2017

(65) Prior Publication Data

US 2017/0362969 A1 Dec. 21, 2017

(30) Foreign Application Priority Data

Jun. 20, 2016 (DE) ..... 10 2016 210 979

(51) Int. Cl.

| | |
|---|---|
| ***F01L 13/00*** | (2006.01) |
| ***F01L 1/053*** | (2006.01) |
| *F01L 1/46* | (2006.01) |
| *F01L 1/047* | (2006.01) |
| *F01L 1/18* | (2006.01) |

(52) U.S. Cl.

CPC ..... *F01L 13/0063* (2013.01); *F01L 1/047* (2013.01); *F01L 1/0532* (2013.01); *F01L 13/0036* (2013.01); *F01L 1/181* (2013.01); *F01L 1/46* (2013.01); *F01L 2001/0473* (2013.01); *F01L 2001/0478* (2013.01);

(Continued)

(58) Field of Classification Search

CPC ..... F01L 2001/0473; F01L 1/18; F01L 1/46; F01L 13/0063; F01L 2105/00; F01L 2820/032

USPC ..... 123/90.17, 90.18, 90.2, 90.31, 90.32, 123/90.44

See application file for complete search history.

(56) References Cited

U.S. PATENT DOCUMENTS

| | | | | |
|---|---|---|---|---|
| 2010/0077979 | A1* | 4/2010 | Takada | F01L 1/18 123/90.16 |
| 2012/0138002 | A1* | 6/2012 | Tsuzuki | F01L 1/185 123/90.18 |
| 2015/0101552 | A1* | 4/2015 | Choi | F01L 13/0036 123/90.15 |

FOREIGN PATENT DOCUMENTS

| | | |
|---|---|---|
| DE | 19945340 A1 | 3/2001 |

OTHER PUBLICATIONS

English abstract for DE-19945340.

* cited by examiner

*Primary Examiner* — Jorge Leon, Jr.
(74) *Attorney, Agent, or Firm* — Fishman Stewart PLLC

(57) ABSTRACT

A valve train may include a camshaft, a cam follower, and first and second cams mounted axially adjacent in a torque-proof manner on the camshaft. The valve train may also include an adjustment arrangement having adjustable first and second mechanical engagement elements, which may each cooperate with at least one slide guide arranged on the camshaft. The valve train may further include a control shaft or control slide forming a stop for the first and second engagement elements and adjusting the first and second engagement elements into respective switching positions. The cam follower may be drivingly connected with the first and second cams in first and second positions, respectively. The first and second engagement elements may each be adjustable between respective basic positions, in which no contact exists with the associated slide guide, and the respective switching positions, in which the respective (Continued)

engagement element cooperates with the associated slide guide.

17 Claims, 2 Drawing Sheets

(52) U.S. Cl.
CPC ... *F01L 2013/0052* (2013.01); *F01L 2013/10* (2013.01); *F01L 2105/00* (2013.01); *F01L 2820/032* (2013.01)

VALVE TRAIN FOR AN INTERNAL COMBUSTION ENGINE

CROSS-REFERENCE TO RELATED APPLICATIONS

This application claims priority to German Patent Application No. DE 10 2016 210 979.0, filed on Jun. 20, 2016, the contents of which are incorporated herein by reference in its entirety.

TECHNICAL FIELD

The present invention relates to a valve train for an internal combustion engine with a camshaft and with a cam follower. The invention furthermore relates to an internal combustion engine with such a valve train.

BACKGROUND

From DE 199 45 340 A1 a generic valve train for an internal combustion engine is known, with a camshaft and with a cam follower and with a first cam mounted on the camshaft in a torque-proof manner, and with a second cam, arranged in a torque-proof manner and axially adjacent to the first cam. The cam follower is drivingly connected here in a first position with the first cam and in a second position with the second cam.

A disadvantage in valve train known from the prior art, however, is that the latter requires an actuator for transferring the cam follower from its first into its second position, wherein such actuators are not only comparatively expensive, in particular also with regard to their assembly costs, but in addition also necessitate and installation space requirement which is not to be underestimated, which is increasingly problematic in particular in the area of cramped engine compartments.

SUMMARY

The present invention is therefore concerned with the problem of indicating for a valve train of the generic type an improved or at least an alternative embodiment, which in particular is able to be produced at a more favourable cost.

This problem is solved according to the invention by the subject of the independent claims. Advantageous embodiments are the subject of the dependent claims. The present invention is based on the general idea of firstly indicating a valve train with an adjustable cam follower, which manages without an actual active actuator for the adjustment of the cam follower. The valve train for an internal combustion has here in a known manner a camshaft and a cam follower, and a first cam, mounted in a torque-proof manner on the camshaft, and a second cam arranged in a torque-proof manner and axially adjacent to the first cam. The cam follower is drivingly connected here in a first position with the first cam and in a second position with the second cam. According to the invention, an adjustment arrangement is now provided, which has an adjustable first mechanical engagement element, which cooperates with at least a first slide guide, arranged on the camshaft, and an adjustable second mechanical engagement element, which cooperates with at least a second slide guide arranged on the camshaft. The first and second engagement element are adjustable here respectively between a basic position, in which no contact exists with the associated slide guide, and a switching position, in which the respective engagement element cooperates with the associated slide guide. For the adjusting of the engagement elements into their respective switching position, according to the invention no actuator is now provided here, but rather only a control shaft or a control slide, which in a first position forms a stop for the first engagement element, and in at least a second position forms a stop for the second engagement element, and thereby in the first position adjusts the first engagement element into its switching position, and in the second position adjusts the second engagement element into its switching position. In the first position, the control shaft or respectively the control slide has here no stop for the second engagement element, but rather for example a pass-through, so that the control shaft or respectively the control slide in the respective first position does not actuate the second engagement element. With the valve train according to the invention therefore for the first time an adjusting of the respective engagement into its switching position is possible exclusively via a stop and without an actuator which is to be switched actively, so that an actuator per se can be dispensed with, whereby not only cost advantages, but also considerable installation and installation space advantages can be achieved. In addition, no separate energy supply has to be provided or respectively installed for such an actuator.

In an advantageous further development of the solution according to the invention, the control shaft is configured as a camshaft. By means of such a camshaft, by a simple turning of the control shaft a stop can be provided for the first or second engagement element, and the latter can be actuated or not via this according to the rotation position of the camshaft. Such a camshaft can be turned here for example by an electric motor, in particular a stepping motor. In order to realize a failsafe function, the control shaft or respectively the control slide can be pre-stressed for example into a predefined position by means of a spring.

In an alternative embodiment of the solution according to the invention, the control shaft has two first openings and two second openings, in particular aligned orthogonally, angled thereto, which run transversely to the longitudinal axis of the control shaft and wherein the control shaft, depending on the rotation position, actuates either the first engagement element or the second engagement element. In a first rotation position, therefore, the control shaft actuates the first engagement element, by the latter being pressed against the control shaft, serving in this case as a stop. The openings can be formed here as through-openings or only as openings in the manner of blind holes. However, in this rotation position of the control shaft, the second engagement can dip through the second opening, aligned orthogonally thereto, and thereby does not experience any resistance at the control shaft, which would lead to a switching of the second engagement element. Similarly as in the embodiment with the camshaft, already here a turning by a predetermined angle, by 90° in the case of openings aligned orthogonally to one another, is sufficient for actuating the first or second engagement element.

In a further alternative embodiment of the solution according to the invention, the control slide has two through-openings, wherein the control slide, depending on the sliding position, actuates either the first engagement element or the second engagement element.

Here, also, the control slide serves again as a stop for one of the two engagement elements, whilst in this position the respective other engagement element dips through the associated through-opening and thereby traverses the control slide unimpeded.

In an advantageous further development of the solution according to the invention, the cam follower has a roller pin and a roller mounted rotatably thereon. The engagement elements are preferably directed here through the roller pin and are thereby fastened on the cam follower without further attachment. In the roller pin itself, furthermore, an arresting device can be arranged for each engagement element, which arresting device has respectively a spring-loaded arresting element, which is prestressed against an associated arresting recess on the associated engagement element and arrests the latter in its basic position or switching position. The arresting device therefore forms two detent positions, namely the basic position or respectively the switching position of the engagement element, wherein both in the basic position and also in the switching position the spring-loaded arresting element engages into the respectively associated arresting recess, which is arranged on the engagement element. Such an arresting device ensures in a simple, favourably priced, but at the same time reliable manner the respectively predefined position of the engagement element.

In a further advantageous embodiment of the solution according to the invention, an adjustment arrangement, in particular an electric motor or electric adjuster, is provided for the adjusting of the control shaft or of the control shaft or of the control slide. Such an electric motor can therefore accomplish the comparatively small adjustment movements of the control shaft or respectively of the control slide without difficulty and is, in addition, favourably priced and compact, which is of great advantage in particular in the area of cramped, modern engine compartments.

Expediently, the first slide guide has at the end a ramp structure, which is configured such that the first engagement element can be brought out of engagement with the first slide guide and therefore transferred into its basic position. Such a ramp structure can be achieved in a simple manner here by a continuously reducing groove depth of the slide guide. In the same manner, such a ramp structure can of course also be provided on the second slide guide.

The present invention is further based on the general idea of equipping an internal combustion engine with the previously described valve train, whereby an internal combustion engine can be provided, which is optimized with regard to installation space, and is favourably priced.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
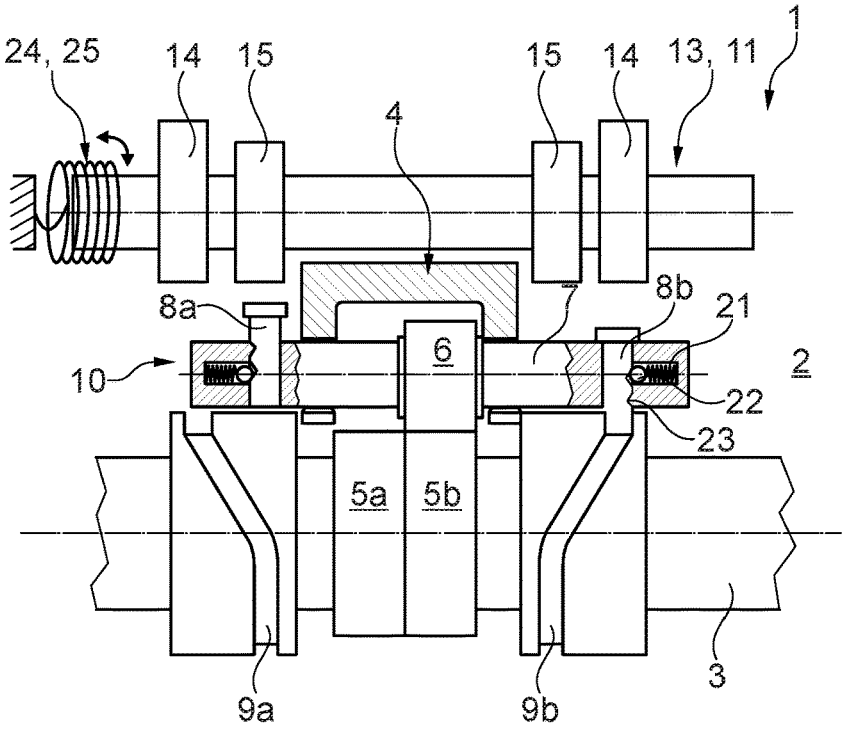
FIG. 1 a valve train according to the invention for an internal combustion engine with a control shaft configured as a camshaft, FIG. 2 an alternative embodiment of the control shaft, FIG. 3 an alternative embodiment of the valve train according to the invention, with a control slide.
Figure 2:
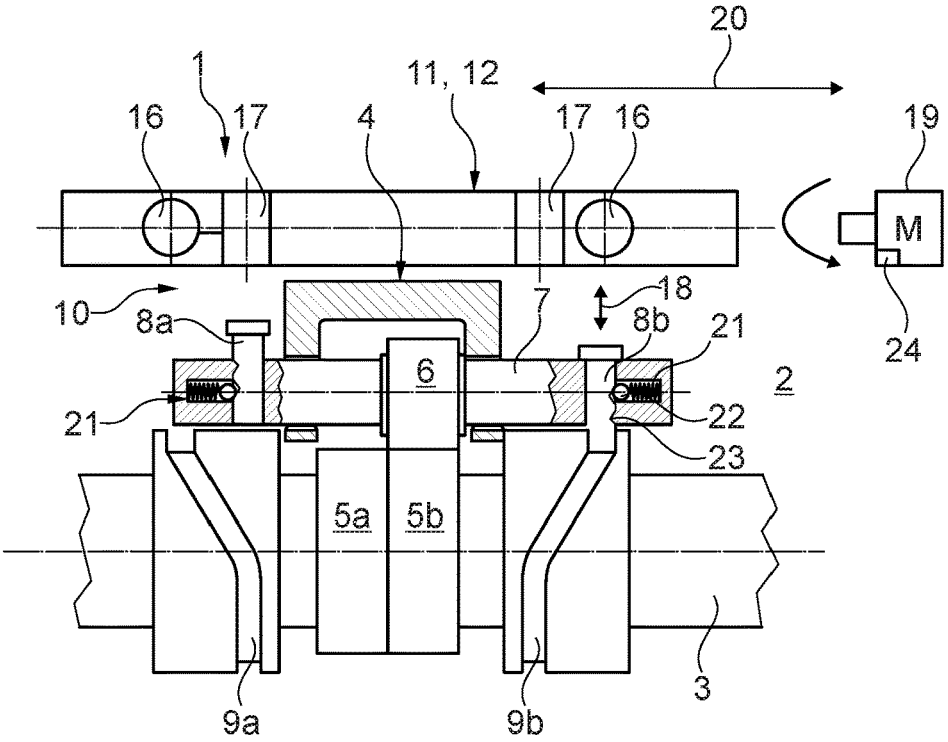
Figure 3:
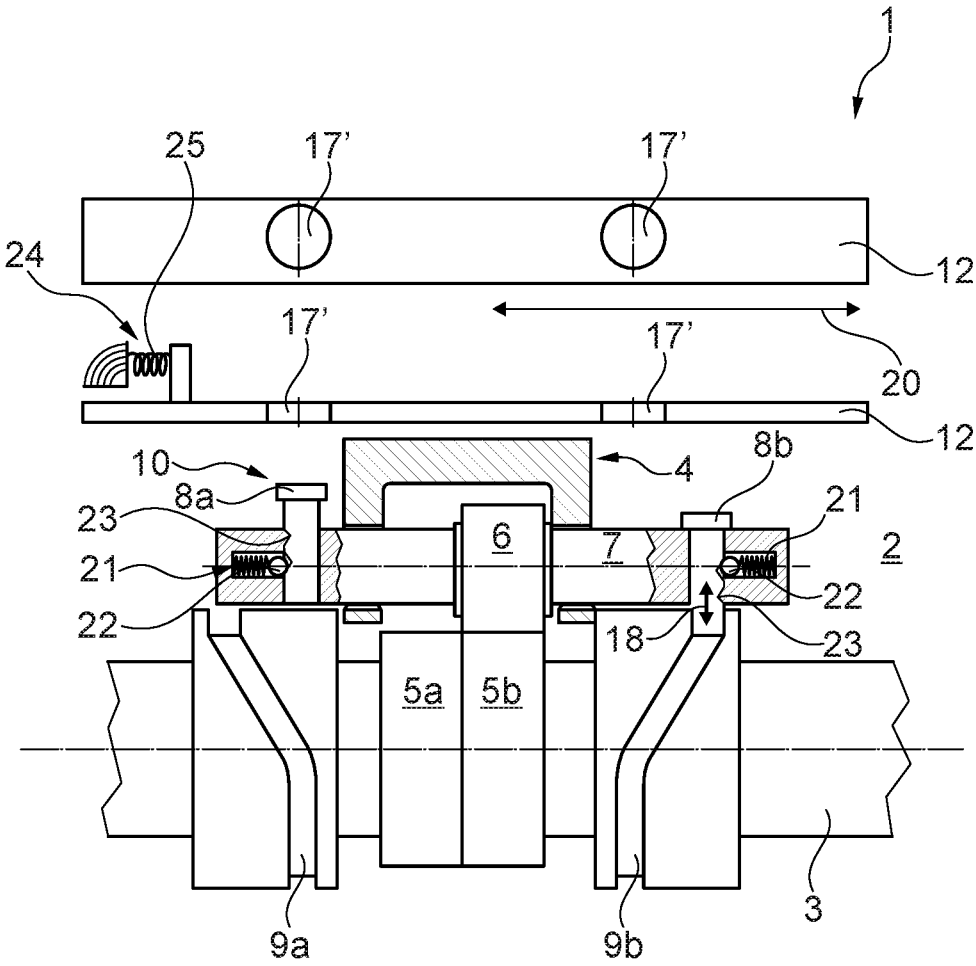

According to FIGS. 1 to 3, a valve train 1 according to the invention of an otherwise not shown internal combustion engine 2 has a camshaft 3 and a cam follower 4. A first cam 5*a* and a second cam 5*b* are arranged here in a torque-proof manner on the camshaft 3, the cam profiles of which cams can be alternatively picked up by the cam follower 4 and transferred to an associated valve, for example an inlet valve or an outlet valve of a cylinder. Here, the two cams 5*a*, 5*b* have different cam profiles, wherein purely theoretically for example the cam 5*b* can consist only of a base circle and thereby brings about a cylinder disconnection.

In a first position, a roller 6 of the cam follower 4 picks up the cam profile of the cam 5*a*, whilst the roller 6 of the cam follower 4 in the second position is drivingly connected with the second cam 5*b* and thereby picks up its profile. The roller 6 is mounted here rotatably on a roller pin 7. According to the invention, an adjustment arrangement 10 is now provided, which has an adjustable first mechanical engagement element 8*a*, which cooperates with at least a first slide guide 9*a*, arranged on the camshaft 3. Furthermore, an adjustable second mechanical engagement element 8*b* is provided, which cooperates with at least a second slide guide 9*b* arranged on the camshaft 3. The first and second engagement element 8*a*, 8*b* are adjustable here respectively between a basic position, in which no contact exists with the associated slide guide 9*a*, 9*b*, and a switching position, in which the respective engagement element 8*a*, 8*b* cooperates with the associated slide guide 9*a*, 9*b*.

According to FIGS. 1 to 3, the first engagement element 8*a* is situated here in its basic position, whilst the second engagement element 8*b* is situated in its switching position and cooperates with the associated slide guide 9*b* on the camshaft 3.

According to the invention, a control shaft 11 (cf. FIGS. 1 and 2) is now provided, or a control slide 12 (cf. FIGS. 2 and 3), which in a first position forms a stop for the first engagement element 8*a* and in at least a second position forms a stop for the second engagement element 8*b* and therefore in the first position adjusts the first engagement element 8*a* into its switching position and in the second position adjusts the second engagement element 8*b* into its switching position. According to FIG. 1 the control shaft 1 is configured here as camshaft 13 and has first and second control cams 14, 15, wherein at least the control cam 14 is configured according to rotation position for adjusting the engagement element 8*a*, 8*b*, cooperating respectively therewith, in its switching position.

Here, at least one control cam 14, 15 can be embodied according to the invention so that by a rotating of the control shaft 11 at least one engagement element 8*a*, 8*b* is adjusted directly into its switching position. It is also conceivable that the control cams 14, 15 are arranged so that depending on the rotation angle different cylinders are able to be actuated or respectively connected to the control shaft 11. Hereby, it is possible for example to operate different cylinders in an engine braking operation and to increase or reduce the braking power by connecting to the control shaft 11 or respectively disconnecting a further cylinder from the control shaft 11.

Observing the control shaft 11 according to FIG. 2, it can be seen that it has two first openings 16 and two second openings 17, aligned orthogonally thereto, wherein the control shaft 11 depending on the rotation position actuates either the first engagement element 8*a* or the second engagement element 8*b*. In the example which is shown, the openings 16, 17 are aligned orthogonally to one another, wherein of course it is clear that these can also be oriented at a different angle to one another. In the state illustrated according to FIG. 2, the first opening 16 points into the plane of the drawing and thereby runs transversely to an adjustment direction 18 of the engagement elements 8*a*, 8*b*, whereby the control shaft 11 forms a stop for the second engagement element 8*b*. In this position, the second opening 17 is aligned with the first engagement element 8*a*, so that the latter, on an upward movement of the cam follower 4, can engage into the opening 17 and thereby is not adjusted by the control shaft 11. The second engagement element 8*b*, on the other hand, strikes with its head against the control shaft 11 and is thereby adjusted from its basic position into its switching position.

According to FIG. 2, an adjustment arrangement 19 is shown for turning the control shaft 11, for example an electric motor or electric adjuster, wherein the adjustment arrangement 19 can of course also be operated hydraulically or pneumatically. In the same way, the control shaft 11 illustrated according to FIG. 2 can also be adjusted in a translatory manner for adjusting the respective engagement elements 8*a*, 8*b* from their basic position into their switching position, so that in this case no turning of the control shaft 11 takes place and this is configured, in this case, as control slide 12.

In the embodiment of the valve train according to the invention, illustrated according to FIG. 3, a comparatively simple control slide 12 is provided, which has only two through-openings 17', which as regards to their function correspond to the second through-openings 17 according to FIG. 2 and thereby enable a dipping of the respective engagement element 8*a*, 8*b* through the associated through-opening 17', depending on the position of the control slide 12. The control slide 12 illustrated according to FIG. 3 therefore does not need any further through-openings, but rather is simply displaced by a displacement along the direction 20 so that the control slide 12 serves firstly for the respective engagement element 8*a*, 8*b* as a stop, and for the other engagement 8*b*, 8*a* offers the possibility for passage through the respective through-opening 17', so that it is not actuated by the control slide 12.

The control shaft 11 is also conceivable as passable for several cylinders. In this case, the control cam 14, 15 would have a different shape, in order to then be able to nevertheless connect the cylinders sequentially with the passable control shaft 11. This becomes necessary, because with the sequential connecting, the control shaft 11 is rotated into different positions. In order to also combine the sequential connecting with the other two embodiments, the control shaft 11 with (through)-openings 16, 17 and the control slide 12 (perforated sheet), these are to be likewise adapted. The control slide 12 is to have elongated holes, if applicable, and the control shaft 11 with the openings 16, 17 can be equipped with several openings 16, 17 at different positions.

In the majority of embodiments shown, the situation is such that a hitherto necessary separate actuator for adjusting the respectively associated engagement element 8*a*, 8*b* can now be dispensed with, whereby the valve train 1 according to the invention can be constructed at a more favourable cost, with a more compact structure and with improved functional reliability. An adjustment of the respective engagement element 8*a*, 8*b* from its basic position into its switching position takes place here preferably by an upward movement of the cam follower 4 and, in the course of this, by a striking of the respective engagement element 8*a*, 8*b* against the control shaft 11 or respectively the control slide 12, whereupon the engagement element 8*a*, 8*b* is adjusted. An additional adjustment arrangement, to be supplied with energy separately, or respectively an additional actuator to be supplied with energy separately, is therefore not needed for adjusting the engagement elements 8*a*, 8*b* in these embodiments. The individual control cams 14, 15 or respectively the openings 16, 17, 17' are arranged or respectively constructed here so that only an associated cylinder is affected by the switchover or for example can also be adjusted in an alternating manner.

In a further advantageous embodiment, a control cam 15 can also be provided with a zero stroke, wherein with a zero stroke cylinder disconnection or with an engine braking operation with a cam with very small stroke, a control cam 14 must be embodied so that on turning of the control shaft 11 the engagement element 8*a*, 8*b* is directly activated, without the cam stroke (as it is not present). Here, the rotational movement of the control shaft via the control cam contour is transferred into a linear movement, thereby comes in contact with the engagement element 8*a*, 8*b* and thereby adjusts the latter in an axial direction. The resetting of the engagement element 8*a*, 8*b* takes place via a ramp structure in the slide guide 9*a*.

Observing FIGS. 1 to 3 once again, it can be seen that the engagement elements 8*a*, 8*b* are directed through the roller pin 7 and are thereby held by the latter. Furthermore, an arresting arrangement 21 is preferably arranged in the roller pin 7 for each engagement element 8*a*, 8*b*, which arresting arrangement respectively has a spring-loaded arresting element 22, which is prestressed against an associated arresting recess 23 on the associated engagement element 8*a*, 8*b* and arrests the latter in two different detent positions in its basic position or switching position, as is clearly shown according to FIGS. 1 to 3.

A resetting of the respective engagement element 8*a*, 8*b* from its switching position into its basic position can take place for example by a ramp structure, not shown in further detail, of the respectively associated slide guide 9*a*, 9*b*, which is realized for example by a reduction of the groove depth. Provision can therefore be made that optionally or cumulatively the first slide guide 9*a* has at the end a ramp structure which is configured such that the first engagement element 8*a* is brought out of engagement with the first slide guide 9*a* and into its basic position, and/or that the second slide guide 9*b* has at the end a ramp structure which is configured such that the second engagement element 8*b* is brought out of engagement with the second slide guide 9*b* and into its basic position.

In addition, a safety arrangement 24 can be provided, which places the control shaft 11 or the control slide 12 into a predefined position and thereby realizes a failsafe. The resetting can take place e.g. by a spring 25 or within the adjustment arrangement 19, in particular within the electric adjuster. The predefined position can be realized e.g. by a spring-loaded detent position.

With the valve train 1 according to the invention, and in particular with the control shaft 11 according to the invention or respectively with the control slide 12, which can be configured for example as a favourably priced perforated sheet, a particularly simple adjustment, because no actuators are necessary, of the engagement elements 8*a*, 8*b* can be brought about from their basic position into their switching position. Hereby, the entire valve train 1 can be produced not only at a more favourable cost, but also more compactly and more reliably as regards to function.

The invention claimed is:

1. A valve train for an internal combustion engine, the valve train comprising:

a camshaft and a cam follower;

a first cam mounted in a torque-proof manner on the camshaft, and a second cam arranged in a torque-proof manner on the camshaft axially adjacent to the first cam;

an adjustment arrangement having an adjustable first mechanical engagement element, which cooperates with at least one slide guide arranged on the camshaft, and an adjustable second mechanical engagement element, which cooperates with at least a second slide guide arranged on the camshaft; and a control shaft, which, in a first position, forms a stop for the first engagement element and adjusts the first engagement element into a respective switching position, and in at least a second position forms a stop for the second engagement element and adjusts the second engagement element into a respective switching position;

wherein the cam follower, in the first position, is drivingly connected with the first cam, and in the second position, is drivingly connected with the second cam;

wherein the first engagement element and the second engagement element are each adjustable between respective basic positions, in which no contact exists with an associated one of the first and second slide guides, and the respective switching positions, in which a respective one of the first and second engagement elements cooperates with the associated one of the first and second slide guides; and wherein the control shaft is configured as a second camshaft with at least two control cams.

2. The valve train according to claim 1, wherein at least one of:

at least one control cam of the at least two control cams is configured such that a turning of the control shaft adjusts at least one engagement element of the first and second engagement elements directly into its switching position; and at least one cam of the at first and second cams has one of a zero stroke or a stroke less than 6 mm, and at least one control cam of the at least two control cams is configured such that turning of the control shaft directly activates the at least one engagement element without a lever movement.

3. The valve train according to claim 2, wherein the at least two control cams are arranged so that, depending on a turning angle, different cylinders of the internal combustion engine are one of actuatable, connectable to the control shaft, or disconnectable from the control shaft.

4. The valve train according to claim 1, wherein the at least two control cams are arranged so that, depending on a turning angle, different cylinders of the internal combustion engine are one of actuatable, connectable to the control shaft, or disconnectable from the control shaft.

5. The valve train according to claim 1, wherein the control shaft has two first openings and two second openings angled with respect to the two first openings, wherein the control shaft, depending on a rotation position, serves as a stop for one of the first engagement element and the second engagement element, and actuates the one of the first engagement element and the second engagement element.

6. The valve train according to claim 1, wherein the cam follower has a roller pin and a roller rotatably mounted on the roller pin.

7. The valve train according to claim 6, wherein the first and second engagement elements are directed through the roller pin.

8. The valve train according to claim 6, further comprising an arresting device for each of the first and second engagement elements arranged in the roller pin, the arresting device having a spring-loaded arresting element, which is prestressed against an associated arresting recess on an associated engagement element of the first and second engagement elements and arrests the associated engagement element in the respective basic position or the respective switching position of the associated engagement element.

9. The valve train according to claim 1, wherein at least one of:

the at least one slide guide has at an end a ramp structure configured such that the first engagement element is brought out of engagement with the first slide guide and into the basic position of the first engagement element; and the second slide guide has at an end a ramp structure configured such that the second engagement element is brought out of engagement with the second slide guide and into the basic position of the second engagement element.

10. The valve train according to claim 1, further comprising a second adjustment arrangement configured to adjust the control shaft.

11. The valve train according to claim 10, wherein the second adjustment arrangement is one of an electric motor and an electric adjuster.

12. The valve train according to claim 1, wherein the control shaft has a safety arrangement, which places the control shaft into a predefined position.

13. The valve train according to claim 12, wherein the safety arrangement has a spring, which prestresses the control shaft into the predefined position.

14. A valve train for an internal combustion engine, the valve train comprising:

a camshaft and a cam follower;

a first cam mounted in a torque-proof manner on the camshaft, and a second cam arranged in a torque-proof manner on the camshaft axially adjacent to the first cam;

an adjustment arrangement having an adjustable first mechanical engagement element, which cooperates with at least one slide guide arranged on the camshaft, and an adjustable second mechanical engagement element, which cooperates with at least a second slide guide arranged on the camshaft; and a control shaft, which, in a first position, forms a stop for the first engagement element and adjusts the first engagement element into a respective switching position, and in at least a second position forms a stop for the second engagement element and adjusts the second engagement element into a respective switching position;

wherein the cam follower, in the first position, is drivingly connected with the first cam, and in the second position, is drivingly connected with the second cam; and wherein the first engagement element and the second engagement element are each adjustable between respective basic positions, in which no contact exists with an associated one of the first and second slide guides, and the respective switching positions, in which a respective one of the first and second engagement elements cooperates with the associated one of the first and second slide guides; and wherein the control shaft has two first openings and two second openings angled with respect to the two first openings, wherein the control shaft, depending on a rotation position, serves as a stop for one of the first engagement element and the second engagement element, and actuates the one of the first engagement element and the second engagement element.

15. The valve train according to claim 14, wherein the cam follower has a roller pin and a roller rotatably mounted on the roller pin, the first and second engagement elements being directed through the roller pin.

16. The valve train according to claim 15, further comprising an arresting device for each of the first and second engagement elements arranged in the roller pin, the arresting device having a spring-loaded arresting element, which is prestressed against an associated arresting recess on an associated engagement element of the first and second engagement elements and arrests the associated engagement element in the respective basic position or the respective switching position of the associated engagement element.

17. An internal combustion engine comprising:

a valve train having:

a camshaft and a cam follower;

a first cam mounted in a torque-proof manner on the camshaft, and a second cam arranged in a torque-proof manner on the camshaft axially adjacent to the first cam;

an adjustment arrangement having an adjustable first mechanical engagement element, which cooperates with at least one slide guide arranged on the camshaft, and an adjustable second mechanical engagement element, which cooperates with at least a second slide guide arranged on the camshaft; and a control slide, which, in a first position, forms a stop for the first engagement element and adjusts the first engagement element into a respective switching position, and in at least a second position forms a stop for the second engagement element and adjusts the second engagement element into a respective switching position;

wherein the cam follower, in the first position, is drivingly connected with the first cam, and in the second position, is drivingly connected with the second cam;

wherein the first engagement element and the second engagement element are each adjustable between respective basic positions, in which no contact exists with an associated one of the first and second slide guides, and the respective switching positions, in which a respective one of the first and second engagement elements cooperates with the associated one of the first and second slide guides; and wherein the control slide has two through-openings, wherein the control slide, depending on a sliding position, serves as a stop for one of the first engagement element and the second engagement element, and actuates the one of the first engagement element and the second engagement element.

* * * * *